US005236883A

United States Patent [19]

Nakazawa et al.

[11] Patent Number: 5,236,883

[45] Date of Patent: Aug. 17, 1993

[54] HEAT-SENSITIVE RECORDING MATERIAL

[75] Inventors: Atsushi Nakazawa; Yoshitaka Tomino; Shuji Saito; Hideaki Shinohara, all of Tokyo, Japan

[73] Assignee: Oji Paper Co., Ltd., Tokyo, Japan

[21] Appl. No.: 622,047

[22] Filed: Dec. 4, 1990

[30] Foreign Application Priority Data

Dec. 5, 1989 [JP] Japan ..... 1-314159
Mar. 1, 1990 [JP] Japan ..... 2-47336

[51] Int. Cl.[5] ..... B41M 5/40

[52] U.S. Cl. ..... 503/200; 427/152; 503/226

[58] Field of Search ..... 503/200, 226; 427/152

[56] References Cited

PUBLICATIONS

EP-A-264827 (Kanzaki Paper Manufacturing Company Limited) Dated: Apr. 27, 1988.

Patent Abstracts of Japan, vol. 14, No. 251 (M-979) (4194), May 29, 1990, & JP-A-02 70478 (Oji Paper Company Limited), Mar. 9, 1990.

Patent Abstracts of Japan, vol. 14, No. 247 (M-978) (4190), May 25, 1990, & JP-A-02 69285 (Oji Paper Company Limited), Mar. 8, 1990.

Patent Abstracts of Japan, vol. 13, No. 514 (M-894) (3862), Nov. 17, 1989, & JP-A-01 208190 (Oji Paper Company Limited), Aug. 22, 1989.

Patent Abstracts of Japan, vol. 13, No. 458 (M-880) (3806), Oct. 17, 1989, & JP-A-01 178486 (Oji Paper Company Limited), Jul. 14, 1989.

*Primary Examiner*—Pamela R. Schwartz

*Attorney, Agent, or Firm*—Armstrong, Westerman, Hattori, McLeland & Naughton

[57] ABSTRACT

A heat-sensitive recording material having an improved color image-forming property and an enhanced gloss and resistance to water, oily substances and plasticizers, is provided with a heat-sensitive color-forming layer formed on a substrate surface and comprising a substantially colorless dye precursor, a color-developing agent and a binder; an intermediate layer formed on the color-forming layer and comprising a hydrophilic polymeric material and a pigment; a glossy surface layer formed on the intermediate layer and comprising a hydrophobic polymeric material having a glass transition point of 60° C. or more, and a lubricant; and optionally, an additional intermediate layer formed between the color-forming layer and the intermediate layer and comprising at least one member selected from hydrophilic polymeric materials and hydrophobic polymeric materials.

20 Claims, No Drawings

HEAT-SENSITIVE RECORDING MATERIAL

BACKGROUND OF THE INVENTION

1. Field of the Invention

The present invention relates to a heat-sensitive recording material. More particularly, the present invention relates to a heat-sensitive recording material having not only an excellent image and color-forming property, recording property and storing durability, but also an enhanced gloss on the recording face thereof.

2. Description of the Related Arts

It is known that a conventional heat-sensitive recording material comprises a substrate material, for example, a paper sheet, synthetic paper sheet, or a plastic resin film, and a heat-sensitive color-forming layer formed on a surface of the substrate material and comprising a substantially colorless dye precursor consisting of, for example, an electron-donative leuco basic dye, a color-developing agent consisting of an organic acid material, for example, an electron-acceptive phenolic compound, and a binder, and the colored recording images can be formed by reacting the dye precursor with the color-developing agent upon applying a heat energy.

This type of heat-sensitive recording material is advantageous in that colored images can be easily formed only by heating imagewise and the recording apparatus can be made relatively compact and in a small size at a low cost, and easily maintained, and thus are widely utilized as information-recording materials for various printers used with, for example, computers, facsimile machines, automatic ticket-vending machines, scientific measurement recorders, and CRT medical measurement recorders.

Nevertheless, the conventional heat-sensitive recording materials in which only the heat-sensitive color-forming layer comprising the dye precursor, the color-developing agent and the binder is directly formed on the substrate material is disadvantageous in that the heat-sensitive color-forming layer is unstable with respect to light, water, heat, plasticizing agents and oily substances, and thus deteriorates in quality with a lapse of time. Also, the conventional heat-sensitive recording materials are disadvantageous in that, when a colored image-forming operation is applied to the heat-sensitive color-forming layer the resultant image-formed portions and the non-image-formed portions in the layer have a relatively low gloss, because the heat sensitive color-forming layer is directly exposed to the outside.

To improve the storage stability of the conventional heat-sensitive recording materials, various attempts have been made to coat the surface of the heat-sensitive color-forming layer with a specific coating layer. For example, Japanese Unexamined Patent Publication No. 56-146,794 discloses the coating of the surface of the heat-sensitive color-forming layer with an aqueous emulsion of a hydrophobic polymeric compound, to thereby form a surface-covering layer.

Also, Japanese Unexamined Patent Publication No. 58-199,189 discloses an improved heat-sensitive recording material in which an upper surface of a heat-sensitive color-forming layer is coated with an aqueous solution of a water-soluble polymeric compound or an aqueous emulsion of a hydrophobic polymeric compound to form an intermediate layer, and the intermediate layer surface is coated with an oily paint comprising, as a resinous component, a hydrophobic polymeric compound, to thereby form a surface-covering layer.

Where the above-mentioned surface-covering layer is formed, it was found that, when the resultant heat-sensitive recording materials are brought into contact with a thermal head of a printer to form colored images thereon, sometimes the thermal head is adhered to the surface of the recording material. Therefore, the above-mentioned heat-sensitive recording materials do not have a satisfactory recording operability. Especially, in the case of video printers by which colored images having a high degree of harmony are to be recorded, an adhesion of the recording material to the thermal head must be prevented.

SUMMARY OF THE INVENTION

An object of the present invention is to provide a heat-sensitive recording material having an excellent water resistance, heat resistance, plasticizer resistance and oil resistance, and a satisfactory storage stability, and allowing the forming thereon of clear colored images having a high color darkness (depth), harmony and gloss similar to those provided by a photographic printing paper sheet for silver salt photography.

Another object of the present invention is to provide a heat-sensitive recording material which does not adhere to a thermal head of a printer and has an excellent information-recording property.

Still another object of the present invention is to provide a heat-sensitive recording material useful for video printers (CRT image-forming heat-sensitive recording apparatus), recently used for recording colored images with a high quality compared to that of the photographic images, for medical diagnoses which must have a high storage stability in terms of the quality of the images, for facsimile printers in which the resultant colored images must have a high storage durability, and for label sheets in a POS bar code price-indicating system, to be attached to an inside surface of a polyvinyl chloride wrapping film containing a plasticizing agent, for packaging fresh food or meat containing oily or fatty substances.

The above-mentioned objects can be attained by the heat-sensitive recording material of the present invention which comprises a substrate material;

a heat-sensitive color-forming layer formed on a surface of the substrate material and comprising a substantially colorless dye precursor, a color developing agent reactive with the dye precursor upon heating to develop a color, and a binder;

an intermediate layer formed on the heat-sensitive color-forming layer and comprising, as a principal component, a mixture of a hydrophilic polymeric material with a pigment; and a glossy surface layer formed on the intermediate layer and comprising, as a principal component, a mixture of a hydrophobic polymeric material having a glass transition point of 60° C. or more with a lubricant.

Optionally, the heat sensitive recording material of the present invention further comprises an additional intermediate layer formed between the heat-sensitive color-forming layer and the intermediate layer and comprising at least one member selected from the group consisting of hydrophilic polymeric materials and hydrophobic polymeric materials.

DESCRIPTION OF THE PREFERRED EMBODIMENTS

The heat-sensitive recording material of the present invention comprises a substrate material, a heat-sensitive color-forming layer formed on a surface of the substrate material, an intermediate layer formed on the heat-sensitive recording layer, and a glossy surface layer formed on the intermediate layer.

The substrate material usable for the present invention is usually selected from fine paper sheets, middle quality paper sheets, coated paper sheets, cast-coated paper sheets, paper boards, thin paper sheets, plastic resin films, synthetic paper sheets, laminated paper sheets, and metal foils, for example, aluminum foils. Preferably, the substrate material is in the form of a sheet and has a basis weight of 40 to 170 g/m$^2$.

The heat-sensitive color-forming layer is formed on a surface of the substrate material in a conventional coating manner, and preferably is present in a weight of 3 to 10 g/m$^2$.

The heat-sensitive color-forming layer comprises a substantially colorless dye precursor which is electron-donative, a color-developing agent which is electron-acceptive and reactive with the dye precursor upon heating, to develop a color, and a binder.

The dye precursor usable for the present invention preferably comprises at least one fluorine compound selected from:

2,2-bis{4-[6'-(N-cyclohexyl-N-methylamino)-3'-methyl-spiro(phihalide-3,9'-xanthene)-2'-ilamide]phenyl} propane,
3-diethylamino-6-methyl-7-anilinofluoran,
3-pyperidino-6-methyl-7-anilinofluoran,
3-(N-methyl-N-cyclohexylamino)-6-methyl-7-anilinofluoran,
3-diethylamino-7-chloroanilinofluoran,
3-[N-ethyl-N-(p-methylphenyl)amino]-6-methyl-7-anilinofluoran,
3-diethylamino-7-(methatrifluoromethyl)anilinofluoran,
3-[N-ethyl-N-tetrahydrofurfryl]amino-6-methyl-7-anilinofluoran,
3-[N-ethyl-isopentyl]amino-6-methyl-7-anilinofluoran, and
3-[N,N-dibutyl amino-6-methyl-7-anilinofluoran.

The color-developing agent comprises at least one electron-accestive organic acid compound capable of gasifying or liquefying at room temperature or more, preferably upon heating at a temperature of 70° C. or more, and of reacting with the dye precursor upon heating to develop a color.

The color-developing agent usable for the present invention preferably comprises at least one member selected from phenolic compounds, for example, 4,4'-isopropylidene diphenol (bisphenol A), 4,4'-isopropylidene-bis(2-chlorophenol), 4,4'-isopropylidene-bis(2-methylphenol), 4,4'-isopropylidene-bis(2,1-tert-butylphenol), 4,4'-sec-butylidene diphenyl, 4,4'-cyclohexylidene diphenyl, 4-tert-butylphenol, 4-phenylphenol, 4-hydroxydiphenoxide, naphthol, p-naphthol; methyl-4-hydroxybenzoate, 4-hydroxy-acetophenone, salicylic anilide, nobolak phenol-formaldehyde resins, halogenated nobolak phenol-formaldehyde resins, bis(3-methyl-6-tert-butylphenol), propyl p-hydroxy benzoate, isopropyl p-hydroxybenzoate, butyl p-hydroxybenzoate, benzyl p-hydroxybenzoate, and methylbenzyl p-hydroxybenzoate; aliphatic carboxylic acid compounds, for example, oxalic acid, maleic acid, tartaric acid, citric acid, succinic acid and stearic acid; aromatic acid compounds, for example, benzoic acid, p-tert-butyl benzoate, phthalic acid, gallic acid, salicylic acid, 3-isopropyl salicylate, 3,5-di-α-methylbenzyl salicylate, bis(4-hydroxyphenyl)sulfide, 1,7-di(4-hydroxyphenylthio)-3,5-dioxaheptane, and p-nitrobenzoic acid; salts of polyvalent metals, for example, zinc, magnesium, aluminum, calcium, titanium, manganese, tin and nickel, with the above-mentioned acid compounds; and organic hydroxy sulfone compounds, for example, 4,4'-dihydroxydiphenylsulfone, 2,4'-dihydroxydiphenylsulfone, 3,3'-dihydroxy diphenylsulfone, 3,3'-diamino-4,4'-dihydroxydiphenylsulfone, 3,3'-diallyl-4,4'-dihydroxydiphenylsulfone, 3,3'-dichloro-4,4'-dihydroxydiphenylsulfone, 4-hydroxydiphenylsulfone, 4-hydroxy-4'-isopropyldiphenylsulfone, 4-hydroxy-4'-isopropyloxydiphenylsulfone, 4-hydroxy-4'-benzyloxydiphenylsulfone, 2,4-dihydroxy-diphenylsulfone, 2,4'-dihydroxy-4'-methyldiphenylsulfone and 3,4'-dihydroxyphenyl-p-trisulfone.

Usually, the color-developing agent in the heat-sensitive color-forming layer is present in an amount of 1 to 5 parts by weight, preferably 1.5 to 3 parts by weight, per part by weight of the dye precursor.

The binder in the heat-sensitive color-forming layer comprises at least one polymeric compound selected from those usually employed as a binder for a conventional heat-sensitive color-forming layer unless, when mixed with aqueous dispersions of the dye precursor and of the developing agent, the binder causes the resultant mixture to be colored, to be coagulated or to exhibit an increased viscosity. Also, preferably the binder effectively enhances the mechanical strength of the resultant heat-sensitive color-forming layer, and does not cause an undesirable reduction of the heat-sensitivity of the heat-sensitive color-forming layer and an increase in the adhesive property of the heat-sensitive color-forming layer to the thermal head.

The binder usable for the heat-sensitive color-forming layer preferably comprises at least one member selected from water-soluble polymeric materials, for example, polyvinyl alcohol resins, starch and derivatives thereof, Arabic gum, gelatin, cellulose derivatives, for example, methyl cellulose, hydroxyethyl cellulose and hydroxymethyl cellulose, polyvinyl pyrrolidone, polyacrylic acid salts, polyacrylamide, styrene-maleic anhydride copolymers, methyl vinyl ether-maleic anhydride copolymers, and isopropylenemaleic anhydride copolymers, which water-soluble materials are used in the form of an aqueous solution thereof; water-insoluble polymeric materials, for example, styrene-butadiene copolymers and acrylic ester copolymers, which are employed in the form of an aqueous emulsion; and cross-linking reaction products of water-soluble polymeric compounds having a reactive radical, for example, acetacetyl radicals or carboxyl radical and reacted with a cross-linking agent.

The cross-linking agent usable for the water-soluble polymeric materials in the heat-sensitive color-forming layer preferably comprises at least one compound selected from aldehyde compounds, for example, glyoxal and polyaldehyde compounds, polyamine compounds, for example, polyethyleneimine, diglycidyl compounds, for example, glycerol-diglycidylether; dimethylol urea, and inorganic compounds, for example, ammonium persulfate, ferric chloride, and magnesium chloride.

The heat-sensitive color-forming layer optionally contains 10 to 50% by weight of a pigment, particularly a white pigment. The pigment preferably comprises fine particles of at least one member selected from organic pigments, for example, calcium carbonate, magnesium carbonate, kaolin, clay, talc, calcined clay, silica, diatomaceous earth, synthetic aluminum silicate, zinc oxide, titanium dioxide, aluminum hydroxide, barium sulfate, a surface-treated calcium carbonate and a surface treated silica; and organic pigments, for example, urea-formaldehyde resin, styrene-methacrylic acid copolymers and polystyrene resins.

Further, the heat-sensitive color-forming layer optionally contains at least one additive selected from fillers, surfactants and heat-fusible materials (or lubricants).

The heat-fusible materials can be selected from conventional heat-fusible substances having a melting point of from 80° C. to 110° C., for example, fatty acid amide, for example, stearic acid amide, stearic acid ethylenebisamide, oleic amide, palmitic amide, coconut fatty acid amide, behenic amide; wax materials, for example, calcium stearate, polyethylene waxes, carnauba wax, parafin waxes, ester waxes; aromatic carboxylic esters, for example, dimethyl terephthalate ester, dibutyl terephthalate ester, dibenzyl terephthalate ester, dibutyl isophthalate ester, and phenyl 1-hydroxynaphthoate ester; hindered phenolic compounds, for example, 1,2-di(3-methylphenoxy)ethane, 1,2-diphenoxyethane, 1-phenoxy-2-(4-methylphenoxy)ethane, diphenyl carbonate, p-benzyl biphenyl, 2,2'-methylene-bis-(4-methyl-6-tert-butylphenol), 4,4'-butylidene bis(6-tertbutyl-3-methylphenol), 1,1,3-tris(2-methyl-4-hydroxy-5-tert-butyl-phenyl)butane, 2,2'-methylene bis(4-ethyl-6-tert-butylphenol), 2,4-di-tert-butyl-3-methylphenol, and 4,4'-thiobis(3-methyl-6-tert-butylphenol; sensitizing agents, for example, 2-(2'-hydroxy-5'-methylphenyl)-benzotriazol and 2-hydroxy-4-benzyloxy-benzophenone; heat-fusible lubricants, heat-fusible antioxidants and heat-fusible ultraviolet ray-absorbers.

The heat-fusible additive is preferably employed in an amount of 4 parts by weight or less per part by weight of the color-developing agent.

In the heat-sensitive recording material of the present invention, an intermediate layer is formed on the heat-sensitive color-forming layer. This intermediate layer comprises, as a principal component, a mixture of a hydrophilic polymeric material with a pigment, and effectively improves the water resistance, plasticizer resistance and oil resistance of the heat-sensitive recording material, particularly the heat-sensitive color-forming layer. When the above-mentioned resistances are enhanced, the resultant heat-sensitive color-forming layer can be fully protected from the adverse influence of water, plasticizers and oily substances, which accelerate an undesirable fading of the colored images.

The hydrophilic polymeric material usable for the intermediate layer is preferably selected from those having a barrier effect against water, plasticizers and oily substances. For example, the hydrophilic polymeric material comprises at least one member selected from the group consisting of water-soluble polymeric compounds, for example, polyvinyl alcohol resins; modified polyvinyl alcohol resins which are modification reaction products of polyvinyl alcohol resin with at least one member selected from the group consisting of urethane-modification agents, acetal-modification agents, etherification agents, graft-modification agents, phosphate-esterification agents, sulfate-esterification agents and acetacetate-esterification agents; vinyl alcohol copolymers which are saponification products of copolymers of vinyl acetate with at least one member selected from the group consisting of ethylenically unsaturated organic carboxylic acids and partial ester, perfect esters, salts and anhydrides of the above-mentioned carboxylic acids, ethylenically unsaturated nitriles, ethylenically unsaturated amides, ethylenically unsaturated sulfonic acids, ethylenically unsaturated sulfonic acids and salts thereof, $\alpha$-olefins having 2 to 30 carbon atoms, vinyl ether, saturated, branched vinyl fatty acid esters; and casein, and cross-linking reaction products of the above-mentioned water-soluble compounds with a cross-linking agent.

The hydrophilic polymeric material preferably has a degree of polymerization of from 300 to 1,700, more preferably 500 to 1,000. At this degree of polymerization, the hydrophilic polymeric material can impart a satisfactory viscosity and coating property to a coating liquid, for forming the intermediate layer.

In the intermediate layer, the hydrophilic polymeric material, i.e., the water-soluble polymeric material or the cross-linking reaction product of the water-soluble polymeric material with the cross-linking agent, is preferably present in an amount of 50% or more based on the total weight of the intermediate layer.

The cross-linking agent usable for the intermediate layer is preferably soluble in water, and is selected from aldehyde compounds, for example, glyoxal and polyaldehyde; polyamine compounds, for example, polyethyleneimine; epoxy-polyamide resins; diglycidyl compounds, for example, glycerol diglycidylether compounds; dimethylol urea and cross-linking inorganic compounds, for example, ammonium persulfate, ferric chloride, magnesium chloride, ammonium chloride and boric acid.

In the preparation of the cross-linked polymeric material in the intermediate layer, the cross-linking agent is preferably employed in an amount of 3 to 30%, based on the weight of the water-soluble polymeric material.

The pigments in the intermediate layer effectively absorb a melt generated in the glossy surface layer when heated, and increase the surface smoothness of the intermediate layer.

The pigment usable for the present invention preferably comprises at least one member selected from fine particles of kaolin, clay, talc, calcium carbonate, calcined clay, titanium dioxide, diatomaceous earth, silica, synthetic aluminum silicate, synthetic magnesium silicate, aluminum oxide, polystyrene resins, and urea-formaldehyde resins.

Usually, the amount of the pigment in the intermediate layer is preferably 50% or less, based on the total weight of the intermediate layer.

The amount of the intermediate layer is adjusted to a level at which the thermal transfer from the thermal head to the heat-sensitive color-forming layer is not hindered by the intermediate layer. Usually, the intermediate layer is in an amount of 1 to 10 g/m$^2$, preferably 2 to 7 g/m$^2$. In this amount, the resultant intermediate layer can exhibit a satisfactory resistance to water, plasticizers, oily substances, and organic hydrophobic solvents without causing a reduction in the heat-resistivity of the heat-sensitive color-forming layer. After the intermediate layer is formed, preferably the surface of the intermediate layer is subjected to a surface smoothing procedure, for example, by a super calender.

Preferably, the smoothed surface of the intermediate layer has a Bekk smoothness of 1,000 seconds or more, more preferably 1,000 to 10,000 seconds, still more preferably 3,000 to 5,000 seconds. If the Bekk smoothness is less than 1,000 seconds, the resultant intermediate layer does not effectively allow the glossy surface layer formed thereon to exhibit a satisfactory gloss.

The intermediate layer formed between the heat-sensitive color-forming layer and the glossy surface layer is effective as a barrier layer for blocking a penetration of a solvent, for example, toluene or methylethylketone into the heat-sensitive color-forming layer therethrough and for preventing an undesirable color-development in the heat-sensitive color-forming layer.

The intermediate layer is covered by a glossy surface layer, to impart a high gloss to the resultant heat-sensitive recording material.

The glossy surface layer comprises, as a principal component, a mixture of a hydrophobic polymeric material having a glass transition point of 60° C. or more with a lubricant.

The hydrophobic polymeric material preferably comprises at least one member selected from the group consisting of saturated polyester resins, acrylic ester copolymer resins, methacrylic ester copolymer resins, acrylic compound-modified polysiloxane compound copolymer resins, acrylic compound-polymerizable silane compound copolymer resins and cellulosic resins.

The hydrophobic polymeric material preferably has a relatively high glass transition point of about 60° C. to 130° C.

The saturated polyester resins are preferably ester-exchange and polycondensation reaction products of a dicarboxylic component comprising dimethyl terephthalate and isophthalic acid with a diol component comprising ethylene glycol, neopentyl glycol and bisphenol A-dioxyethylether. Note, after the above-mentioned ester-exchange and polycondensation reaction is completed, a non-reacted diol component is removed from the reaction product under a reduced pressure.

In the preparation of the saturated polyester resin, the molar ratio of the dimethyl terephthalate to the isophthalic acid in the dicarboxylic acid component preferably is in the range of from 0.8:1.2 to 1.2:0.8. Also, the diol component preferably comprises 20 to 40 molar % of ethylene glycol, 5 to 15 molar % of neopentyl glycol, and 50 to 70 molar % of bisphenol A-dioxyethylether.

The saturated polyester resins can be used in combination with an additional hydrophobic polymeric material, for example, a modified silicone resin, unless the additional material affects the attaining of the purpose of the present invention. Also, the saturated polyester resins can be cross-linked by a cross-linking agent, for example, melamine type curing agent, acid anhydride type curing agent, isocyanate-type curing agent or epoxy-type curing agent.

The amount of the cross-linking agent to be added to the saturated polyester resin is variable, depending on the OH value of the resin, but usually the cross-linking agent is used in an amount of 1 to 20 parts by weight based on 100 parts by weight of the resin.

In the glossy surface layer, the hydrophobic polymeric material is evenly mixed with a lubricant (release agent).

The lubricant usable for the glossy surface layer comprises at least one member selected from metal salts of higher fatty acids, for example, zinc stearate; waxes, for example, polyethylene waxes and amide waxes; surfactants, for example, fluorine-containing surfactants and phosphate ester type surfactants; and silicone lubricants, for example, reaction-curing type silicone oils, fluorinated alkyl ester-modified silicones and polyester-modified silicones.

Preferably, the lubricant is used in an amount of 0.5 to 30% based on the weight of the hydrophobic polymeric material in the glossy surface layer.

The glossy surface layer should be present in an amount in which the resultant glossy surface layer does not hinder the transfer of heat to the heat-sensitive color-forming layer therethrough. Usually, the amount of the glossy surface layer is from 0.1 to 10 g/m$^2$, preferably 0.2 to 5 g/m$^2$.

The heat-sensitive recording material of the present invention optionally further comprises an additional intermediate layer formed between the heat-sensitive color-forming layer and the intermediate layer and comprising at least one member selected from the group consisting of hydrophilic polymeric materials and hydrohobic polymeric materials.

Preferably, the hydrophobic material in the additional intermediate layer is present in an amount in which the resultant additional intermediate layer can exhibit a water-resistance at a necessary intensity for coating an aqueous solution containing a hydrophilic polymeric material to form the intermediate layer.

In the formation of the additional intermediate layer, even if fine defects are generated therein by, for example, a repelling of a coating liquid for the additional intermediate layer, the fine defects can be covered by the intermediate layer to fully prevent a formation of black spots in the heat-sensitive color-forming layer due to the penetration of the solvent or other foreign substances thereto.

Also, the additional intermediate layer is highly effective for fully preventing an undesirable fading of the colored images formed in the heat-sensitive color-forming layer, due to a penetration of water, a plasticizer and an oily substance thereto.

The hydrophilic polymeric material usable for the additional intermediate layer preferably comprises at least one member selected from the same water-soluble polymeric materials and cross-linking reaction products of the water-soluble polymeric materials with cross-linking agents as those usable for the intermediate layer. Also, the hydrophilic polymeric material preferably has a degree of polymerization of 300 to 1,700, more preferably 500 to 1,000.

The hydrophobic polymeric materials usable for the additional intermediate layer preferably comprises at least one member selected from acrylic ester-based copolymers, methacrylic ester-based copolymers, styrene-butadiene-acrylic ester copolymers and styrene-butadiene-methacrylic ester copolymers.

In the formation of the additional intermediate layer, the hydrophobic polymeric material is used in the form of an aqueous emulsion thereof or a latex.

The total amount of the hydrophilic polymeric material and the hydrophobic polymeric material is preferably 50% by weight or more, based on the entire amount of the additional intermediate layer. If this total amount is less than 50% by weight, the resultant additional intermediate layer sometimes exhibits an unsatisfactory resistance to plasticizers, oily substances and organic hydrophobic solvents.

The cross-linking agents usable for the formation of the additional intermediate layer are the same as those for the intermediate layer.

Preferably, the cross-linking agent is used in an amount of 3 to 30% by weight, based on the weight of the water-soluble polymeric material.

The additional intermediate layer is preferably in an amount of 1 to 5 g/m$^2$, more preferably 1 to 3 g/m$^2$. When formed on the additional intermediate layer, the intermediate layer is preferably in an amount of 1 to 5 g/m$^2$, more preferably 1 to 3 g/m$^2$.

EXAMPLES

The present invention will be further explained by way of specific examples, which are merely representative and do not in any way restrict the scope of the present invention.

Example 1

The following liquids A to D were prepared in the compositions indicated below.

(1) Preparation of aqueous dispersion A containing a dye precursor and a binder for heat-sensitive color-forming layer

| Component | Parts by Weight |
|---|---|
| 3-(N-ethyl-N-cyclohexylamino)-6-methyl-7-anilinofluoran | 5 |
| Aqueous solution containing 10% by weight of methyl vinyl ether-maleic anhydride (molar ratio: 1:1) copolymer | 5 |
| Water | 8 |

(2) Preparation of aqueous dispersion B containing color-developing agent and binder for heat-sensitive color-forming layer

| Component | Parts by Weight |
|---|---|
| 2,4-dihydroxy-diphenylsulfone | 30 |
| Aqueous solution containing 10% by weight of methyl vinyl ether-maleic anhydride (molar ratio: 1:1) copolymer | 30 |
| Water | 22 |

(3) Preparation of aqueous solution C containing hydrophilic polymeric material and pigment for intermediate layer

| Component | Parts by Weight |
|---|---|
| Aqueous solution containing 10% by weight of carboxyl-modified polyvinyl alcohol | 100 |
| Aqueous solution containing 30% by weight of polyamide resin | 3 |
| Aqueous dispersion containing 60% by weight of kaolin | 70 |
| Water | 20 |

(4) Preparation of mixture D containing hydrophobic polymeric material and lubricant for glossy surface layer

| Component | Parts by Weight |
|---|---|
| Saturated polyester resin | 85 |
| Dispersion of 10% by weight of zinc stearate in toluene | 20 |
| Solution of 50% by weight of fluorinated alkyl ester-modified silicone in toluene | 20 |
| Toluene | 200 |
| Methylethylketone | 50 |

In the mixture D, the saturated polyester resin was a polyesterification product of a dicarboxylic acid component consisting of 25 molar parts of dimethyl terephthalate and 25 molar parts of isophthalic acid, with a diol component consisting of 16 molar parts of ethylene glycol, 4 molar parts of neopentyl glycol and 30 molar parts of bisphenol A-dioxyethylether, and had a number average molecular weight Mn of 18,000 and a glass transition point of 74° C.

The dispersion A and the dispersion B were separately placed in a sand grinder and grind-dispersed to an extent such that the particles in the dispersions had an average size of 1 μm or less.

The solution C was stirred in a mixer until the components were evenly mixed with each other, and the mixture D was stirred in a mixer until a clear solution was obtained.

(5) Formation of heat-sensitive color-forming layer

A coating liquid for a heat-sensitive color-forming layer was prepared in the following composition.

| Component | Parts by Weight |
|---|---|
| Dispersion A | 12 |
| Dispersion B | 46 |
| Aqueous dispersion of 60% by weight of calcium carbonate | 40 |
| Aqueous solution of 10% by weight of polyvinyl alcohol | 150 |
| Water | 18 |

The resultant coating liquid was coated on a surface of a substrate sheet consisting of a fine paper sheet with a basis weight of 50 g/m$^2$, and the coated coating liquid layer was dried to form a heat-sensitive color-forming layer having a dry weight of 7 g/m$^2$.

(6) Formation of intermediate layer

The solution C was coated on the resultant heat-sensitive color-forming layer and the coated solution C layer was dried to form an intermediate layer having a dry weight of 3 g/m$^2$.

The resultant intermediate layer surface was calendered, and the calendered surface of the intermediate layer had a Bekk smoothness of 3,000 seconds.

(7) Formation of glossy surface layer

The solution D was coated on the calendered surface of the intermediate layer, and the coated solution D layer was dried to form a glossy surface layer with a dry weight of 2 g/m$^2$.

A heat-sensitive recording sheet composed of the substrate sheet, the heat-sensitive color-forming layer, the intermediate layer and the glossy surface layer, superimposed one on the other in the above-mentioned order, was obtained.

The resultant heat-sensitive recording sheet was left to stand at room temperature for 3 days, then subjected to a printing operation by a heat-sensitive printer (Trademark: VIDEO Heat-Sensitive Printer UP-811, made by Sony), to form a solid black image. During this printing operation the adhesive property of the recording sheet was evaluated.

Also, the darkness of the solid black image on the recording sheet was measured by a color darkness tester (available under a trademark of Macbeth Darkness Tester RD-914, from Kollmorgen Colo.). Furthermore, the glossiness of the recording sheet was measured at an angle of light-incident and angle of light acceptance of 75 degrees, and the pencil-writing property of the recording sheet was evaluated.

Furthermore, the resistances of the recording sheet to water, oil and plasticizer in a polyvinyl chloride film were tested in the following manner.

(1) Water-resistance test

A specimen of the printed recording sheet was immersed in water at room temperature for 24 hours, and then taken out of the water.

The degree of dissolving out of the coated layers in the recording sheet in water was evaluated, and after drying, the darkness of the solid black image on the dried recording sheet was evaluated.

(2) Plasticizer-resistance test

A test piece of the recording sheet was superimposed on a soft polyvinyl chloride film in a manner such that the glossy surface layer came into contact with the polyvinyl chloride film, and then was left to stand at a temperature of 20° C. under a load of 300 g/cm$^2$ for 24 hours.

Thereafter, the darkness of the solid black image on the recording sheet was measured.

(3) Oil-resistance test

The glossy surface layer surface of the recording sheet was coated with a cotton seed oil and then left to stand at a temperature of 20° C. for 24 hours. Thereafter, the darkness of the solid black image on the recording sheet was measured.

The test results are shown in Table 1.

Example 2

The same procedures as in Example 1 were carried out, except that in the solution C the carboxyl-modified polyvinyl alcohol was replaced by an acetacetylated polyvinyl alcohol in the same amount as that mentioned above, and the polyamide resin (cross-linking agent) was replaced by dimethylol urea in the same amount as the polyamide resin.

The test results of the resultant recording sheet are shown in Table 1.

Example 3

The same procedures as in Example 1 were carried out, except that the Bekk smoothness of the resultant intermediate layer surface was adjusted to 5,000 seconds by using a calender.

The test results of the resultant recording sheet are shown in Table 1.

Example 4

The same procedures as in Example 1 were carried out except that, in the mixture D, the dispersion of zinc stearate (lubricant) in toluene was replaced by a solution of 10% by weight of polyester-modified silicone in toluene.

The test results of the resultant recording sheet are indicated in Table 1.

Comparative Example 1

The same procedures in Example 1 were carried out, except that no glossy surface layer was formed on the intermediate layer.

The test results of the resultant recording sheet are shown in Table 1.

Comparative Example 2

The same procedures as in Example 1 were carried out, except that the saturated polyether resin having a glass transition point of 74° C. was replaced by a saturated polyester resin having a number average molecular weight of 20,000 and a glass transition point of 51° C. and consisting of a polyesterification product of a dicarboxylic acid component consisting of 25 molar parts of dimethyl terephthalate and 25 molar parts of isophthalic acid, with a diol component consisting of 40 molar parts of ethylene glycol and 10 molar parts of neopentyl glycol.

The test results are shown in Table 1.

Example 5

The same procedures as in Example 1 were carried out, except that no calender treatment was applied to the intermediate layer surface, which had a Bekk smoothness of 800 seconds.

The test results are shown in Table 1.

TABLE 1

| | Item | | | | | | |
|---|---|---|---|---|---|---|---|
| Example No. | Darkness of recorded image | Resistance to adhesion (*)1 | Gloss | Pencil writing property (*)2 | Water resistance (*)2 | Oil resistance (*)2 | Resistance to plasticizer in polyvinyl chloride resin |
| Example 1 | 1.98 | 4 | 87 | 3 | 3 | 4 | 1.95 |
| Example 2 | 1.97 | 4 | 85 | 3 | 3 | 4 | 1.93 |
| Example 3 | 2.10 | 4 | 90 | 3 | 3 | 4 | 2.05 |
| Example 4 | 1.99 | 4 | 88 | 3 | 3 | 4 | 1.97 |
| Comparative Example 1 | 1.45 | 2 | 50 | 4 | 3 | 3 | 1.25 |
| Comparative Example 2 | 1.95 | 2 | 85 | 3 | 3 | 3 | 1.93 |
| Example 5 | 1.68 | 4 | 61 | 3 | 3 | 3 | 1.53 |

Note:

| (*)1 Class | Notification |
|---|---|
| 4 | No adhesion of thermal head to recording sheet found, and no noise generated on recording sheet during recording operation |
| 3 | No adhesion of thermal head to recording sheet found but slight noise generated on recording sheet during recording operation |

TABLE 1-continued

| Example No. | Item: Darkness of recorded image | Resistance to adhesion (*)1 | Gloss | Pencil writing property (*)2 | Water resistance (*)2 | Oil resistance (*)2 | Resistance to plasticizer in polyvinyl chloride resin |
|---|---|---|---|---|---|---|---|
| 2 | Slight adhesion of thermal head to recording sheet found and resultant images were distorted | | | | | | |
| 1 | Thermal head was frequently adhered to recording sheet and recording sheet could not be smoothly moved | | | | | | |

| (*)2 | Class | Notification |
|---|---|---|
| | 4 | Very good |
| | 3 | Satisfactory |
| | 2 | Not very satisfactory |
| | 1 | Unsatisfactory |

As Table 1 clearly shows, all of the heat-sensitive recording sheets of Example 1 to 5 showed satisfactory test results, but the comparative recording sheets of Comparative Examples 1 and 2 were unsatisfactory in the adhesion resistance, glossiness and resistance to plasticizers thereof.

Example 6

The same procedures as in Example 1 were carried out, with the following exceptions.

An aqueous mixture E for forming an additional intermediate layer was prepared in the following composition.

| Component | Parts by weight |
|---|---|
| Aqueous solution containing 10% by weight of polyvinyl alcohol | 75 |
| Latex containing 45% by weight of styrene-butadiene copolymer | 6 |
| Aqueous solution containing 30% by weight of polyaldehyde | 3 |
| Aqueous dispersion containing 60% by weight of kaolin | 12 |
| Water | 20 |

An aqueous solution C' for forming the intermediate layer was prepared in the following composition.

| Component | Parts by weight |
|---|---|
| Aqueous solution containing 10% by weight of carboxyl-modified polyvinyl alcohol | 100 |
| Aqueous solution containing 30% by weight of polyamide resin | 3 |
| Aqueous dispersion containing containing 60% by weight of kaolin | 13 |
| Water | 20 |

A mixture D' for forming the glossy surface layer was prepared in the following composition.

| Component | Parts by weight |
|---|---|
| Solution containing 40% by weight of methyl methacrylate-based graft copolymer (available under the trademark of Mα-109, from Toa Gosei K.K., and having a glass transition point of 80° C.) in toluene | 50 |
| Dispersion containing 5% by weight of zinc stearate in toluene | 5 |
| Solution containing 50% by weight of fluorinated alkyl-ester-modified silicone in toluene | 5 |
| Toluene | 50 |

The aqueous mixture E was coated in a dry weight of 2 g/m$^2$ on the surface of the heat-sensitive color-forming layer, to form an additional intermediate layer.

This additional intermediate layer surface was coated by the aqueous solution C' in a dry weight of 3 g/m$^2$, to form an intermediate layer.

This intermediate layer was calendered to provide a smooth surface thereof having a Bekk smoothness of 3,000 seconds.

The smooth surface of the intermediate layer was coated by the Mixture D' to form a glossy surface layer having a dry weight of 2 g/m$^2$.

The test results are shown in Table 2.

Example 7

The same procedures as in Example 6 were carried out except that, in the mixture D' for the glossy surface layer, the methylmethacrylate-based graft copolymer was replaced by an acryl-silicone copolymer (available under a trademark of CX-R25-100, from Nihon Shokubai Kagaku Kogyo K.K., and having a glass transition point of 80° C.).

The test results are shown in Table 2.

Example 8

The same procedures as in Example 6 were carried out except that, in the mixture D' for the glossy surface layer, the methylmethacrylate-based graft copolymer was replaced by a saturated polyester resin (available under the trademark of OP-14, from Arakawa Kagaku K.K. and having a glass transition point of 76° C.).

The test results are shown in Table 2.

Example 9

The same procedures as in Example 6 were carried out except that, in the aqueous mixture E for the additional intermediate layer, the styrene-butadiene copolymer latex was replaced by an acrylic copolymer resin (available under the trademark of Movinyl 735 from Hoechst Gosei K.K.).

The test results are shown in Table 2.

Comparative Example 3

The same procedures as in Example 6 were carried out, except that no glossy surface layer was formed.

The test results are shown in Table 2.

Comparative Example 4

The same procedures as in Example 8 were carried out, except that the saturated polyester resin OP-14 was replaced by another saturated polyester resin (available under the trademark of KA-1051T, from Arakawa Kagaku K.K., and having a glass transition point of 52° C.

The test results are shown in Table 2.

Comparative Example 5

The same procedures as in Example 6 were carried out except that, in the preparation of the mixture D' for the glossy surface layer, the zinc stearate dispersion and the fluorinated alkylester-modified silicone solution were omitted.

The test results are shown in Table 2.

TABLE 2

| | Item | | | | | | | |
|---|---|---|---|---|---|---|---|---|
| Example No. | Darkness of recorded image | Resistance to adhesion (*)1 | Gloss | Formation of fine black stain (*)3 | Pencil writing property (*)2 | Water resistance (*)2 | Oil resistance (*)2 | Resistance to plasticizer in polyvinyl chloride resin |
| Example 6 | 1.90 | 4 | 87 | 0 | 3 | 4 | 4 | 1.89 |
| Example 7 | 1.92 | 4 | 90 | 0 | 3 | 4 | 4 | 1.90 |
| Example 8 | 1.89 | 4 | 85 | 0 | 3 | 4 | 4 | 1.88 |
| Example 9 | 1.88 | 4 | 86 | 0 | 3 | 4 | 4 | 1.86 |
| Comparative Example 3 | 1.41 | 2 | 40 | 0 | 4 | 2 | 3 | 1.36 |
| Comparative Example 4 | 1.90 | 2 | 85 | 0 | 3 | 4 | 4 | 1.87 |
| Comparative Example 5 | 1.67 | 2 | 89 | 0 | 4 | 3 | 3 | 1.65 |

Note:
(*)3 The number of fine black stains per $m^2$ of glossy surface layer.

As Table 2 clearly shows, all of the heat-sensitive recording sheets of Examples 6 to 9 showed satisfactory in test results, but the heat-sensitive recording sheets of Examples 3 to 5 were unsatisfactory in at least one of the tested items.

We claim:

1. A heat-sensitive recording material comprising:

a substrate material;

a heat-sensitive color-forming layer formed on a surface of the substrate material and comprising a substantially colorless dye precursor, a color developing agent reactive with the dye precursor upon heating to develop a color, and a binder;

a first intermediate layer formed on the heat-sensitive color-forming layer and comprising, as a principal component, a mixture of a hydrophilic polymeric material with a pigment;

a glossy surface layer formed on the first intermediate layer and comprising, as a principal component, a mixture of a hydrophobic polymeric material comprising at least one member selected from the group consisting of saturated polyester resins, acrylic ester copolymer resins, methacrylic ester copolymer resins, acrylic compound-modified polysiloxane copolymer resins, acrylic compound-polymerizable silane compound copolymer resins, and cellulose resins, with a lubricant; and a second intermediate layer formed between the heat-sensitive color-forming layer and the first intermediate layer, and comprising a mixture of a hydrophilic polymeric material with a hydrophobic polymeric material.

2. The recording material as claimed in claim 1, wherein the hydrophilic polymeric material in the first intermediate layer comprises at least one member selected from the group consisting of polyvinyl alcohol resin; modified polyvinyl alcohol resins which are modification reaction products of polyvinyl alcohol resin with at least one member selected from the group consisting of urethane-modification agents, acetal-modification agents, etherification agents, graft-modification agents, phosphate-esterification agents, sulfate-esterification agents and acetacetate-esterification agents; vinyl alcohol copolymers which are saponification products of copolymers of vinyl acetate with at least one member selected from the group consisting of ethylenically unsaturated organic carboxylic acids and esters, salts and anhydrides of the above-mentioned carboxylic acids, ethylenically unsaturated nitriles, ethylenically unsaturated amides, ethylenically unsaturated sulfonic acids, ethylenically unsaturated sulfonic acids and salts thereof, α-olefins having 2 to 30 carbon atoms, vinyl esters, and saturated branched vinyl fatty acid esters; casein; and cross-linking reaction products of the above-mentioned compounds with a cross-linking agent.

3. The recording material as claimed in claim 2, wherein the hydrophilic polymeric material in the first intermediate layer has a degree of polymerization of from 300 to 1,700.

4. The recording material as claimed in claim 2, wherein the cross-linking agent in the first intermediate layer comprises at least one member selected from the group consisting of glyoxal, polyaldehydes, polyamines, epoxy polyamides, glycidyl compounds, dimethylol urea, ammonium persulfates, ferric chloride, magnesium chloride, ammonium chloride and boric acid.

5. The recording material as claimed in claim 2, wherein the cross-linking agent is used in an amount of 3 to 30% based on the weight of the hydrophilic polymeric material.

6. The recording material as claimed in claim 1, wherein the hydrophilic polymeric material in the first intermediate layer is present in an amount of 50% or more based on the total weight of the intermediate layer.

7. The recording material as claimed in claim 1, wherein the pigment in the first intermediate layer is present in an amount of 50% or less, based on the total weight of the intermediate layer.

8. The recording material as claimed in claim 1, wherein the first intermediate layer is present in an amount of 1 to 10 g/m$^2$.

9. The recording material as claimed in claim 1, wherein the saturated polyester resins are ester-exchange and polycondensation reaction products of a dicarboxylic component comprising dimethyl terephthalate and isophthalic acid, with a diol component comprising ethylene glycol, neopentyl glycol, and bisphenol A-dioxyethylether.

10. The recording material as claimed in claim 9, wherein, in the dicarboxylic acid component, the molar ratio of the dimethyl terephthalate to the isophthalic acid is in the range of from 0.8:1.2 to 1.2:0.8.

11. The recording material as claimed in claim 9, wherein the diol component comprises 20 to 40 molar % of ethylene glycol, 5 to 15 molar % of neopentyl glycol and 50 to 70 molar % of bisphenol A-dioxyethylether.

12. The recording material as claimed in claim 1, wherein the lubricant in the glossy surface layer comprises at least one member selected from the group consisting of metal salts of higher fatty acids, polyethylene waxes, amide waxes, fluorine-containing surfactants, phosphate ester-containing surfactants, reaction-curing silicone oils, fluorinated alkyl ester-modified silicone compounds, and polyester-modifide silicone compounds.

13. The recording material as claimed in claim 1, wherein the lubricant in the glossy surface layer is present in an amount of 0.5 to 30% based on the total weight of the glossy surface layer.

14. The recording material as claimed in claim 1, wherein the glossy surface layer is present in an amount of 0.1 to 10 g/m$^2$.

15. The recording material as claimed in claim 1, wherein the hydrophobic polymeric material in the second intermediate layer comprises at least one member selected from the group consisting of acrylic ester-based copolymers and methacrylic ester-based copolymers.

16. The recording material as claimed in claim 1, wherein the hydrophilic polymeric material in the second intermediate layer comprises at least one member selected from the consisting of polyvinyl alcohol resin; modified polyvinyl alcohol resins which are modification reaction products of polyvinyl alcohol resin with at least one member selected from the group consisting of urethane-modification agents, acetal-modification agents, etherification agents, graft-modification agents, phosphate-esterification agents, sulfate-esterification agents and acetacetate-esterification agents; vinyl alcohol copolymers which are saponification products of copolymers of vinyl acetate with at least one member selected from the group consisting of ethylenically unsaturated organic carboxylic acids and esters, salts and anhydrides of the above-mentioned carboxylic acids, ethylenically unsaturated nitriles, ethylenically unsaturated amides, ethylenically unsaturated sulfonic acids, ethylenically unsaturated sulfonic acids and salts thereof, α-olefins having 2 to 30 carbon atoms, vinyl ether, saturated, and branched vinyl fatty acid esters; casein; and cross-linking reaction products of the above-mentioned materials with cross-linking agents.

17. The recording material as claimed in claim 16, wherein the cross-linking agent is used in an amount of 3 to 30% based on the weight of the hydrophilic polymeric material.

18. The recording material as claimed in claim 1, wherein the second intermediate layer is in an amount of 1 to 5 g/m$^2$.

19. The recording material as claimed in claim 1, wherein the first intermediate layer has a surface thereof having a Beck smoothness of 1,000 seconds or more.

20. The recording material as claimed in claim 1, wherein the hydrophobic polymeric material in the second intermediate layer comprises at least one member selected form the group consisting of styrene-butadiene-acrylic ester copolymers, and styrene-butadiene-methacrylic ester copolymers.

* * * * *